US005187464A

United States Patent [19]

Forgacs

[11] Patent Number: 5,187,464

[45] Date of Patent: Feb. 16, 1993

[54] EXTENDED LIFE POTENTIOMETRIC POSITION TRANSDUCER

[75] Inventor: Robert L. Forgacs, Dearborn Heights, Mich.

[73] Assignee: Ford Motor Company, Dearborn, Mich.

[21] Appl. No.: 880,786

[22] Filed: May 11, 1992

[51] Int. Cl.[5] ..... H01C 10/24

[52] U.S. Cl. ..... 338/149; 338/137; 338/135; 338/162; 338/182; 338/196; 338/176

[58] Field of Search ..... 338/137, 149, 196, 202, 338/325, 333, 170, 171, 182, 184, 176, 162, 136, 135

[56] References Cited

U.S. PATENT DOCUMENTS 4,114,132 9/1978 DeRouen et al. ..... 338/184
4,114,133 9/1978 Stephens ..... 338/184
4,355,293 10/1982 Driscoll .
4,427,966 1/1984 Gratzinger et al. ..... 338/162
4,500,866 2/1985 Romann et al. .
4,616,504 10/1986 Overcash et al. .
4,621,250 11/1986 Echasseriau et al. .
4,693,111 9/1987 Arnold et al. .

*Primary Examiner*—Marvin M. Lateef
*Attorney, Agent, or Firm*—Paul K. Godwin, Jr.; Roger L. May

[57] ABSTRACT

A potentiometric position transducer comprises a resistive track movably mounted within a housing. A portion of the resistive track is between two fixed electrical contact points. A third electrical contact is moveable over such portion, corresponding to the position or setting of an exterior device, such as the throttle of an internal combustion engine. Drive means are provided to move the resistive track, to repeatedly substitute new portions of the resistive track between the two fixed contact points. Wear is spread over the entire resistive track.

19 Claims, 4 Drawing Sheets

EXTENDED LIFE POTENTIOMETRIC POSITION TRANSDUCER

INTRODUCTION

The present invention relates to a potentiometric position transducer suitable for use, for example, for detecting the position of a moveable part such as the throttle valve of an internal combustion engine.

BACKGROUND OF THE INVENTION

Potentiometric position transducers are commonly used to measure or detect position or displacement of a moveable component. A voltage is applied between electrical contacts positioned at opposite ends of a resistive track. A third electrical contact, moveable back and forth over the resistive strip by suitable linkage means, provides an output voltage variable with its position on the track. Advantages of potentiometric position transducers typically include a large output signal voltage, good resolution, relatively low noise to signal ratio and good durability, at least under low vibration conditions.

In a rotary transducer, the resistive element can be provided as a segment of a ring. When a voltage is applied between the two resistor ends, a central sliding contact can pick up a voltage representing the angle of rotation of the shaft or rotor on which the sliding contact is mounted. In a linear transducer, the resistive element typically is an elongate rectangular strip and the central sliding contact is attached to a rod which moves linearly. The voltage signal from the energized resistor is a measure of rod linear position. A rotary potentiometer is illustrated in U.S. Pat. No. 4,621,250 to Echasseriau et al, wherein a stationary resistive track is provided on the cylindrical inside surface of a case or housing. A resilient wiper is carried by a rotor rotatably mounted in the housing. The wiper contacts the resistive track during operation of the potentiometer. A spring placed between the case and the rotor biases the rotor to a rest position. Similarly, in U.S. Pat. No. 4,355,293 to Driscoll a rotary potentiometer is disclosed for measuring the position of the throttle blade of an internal combustion engine. A flexible resistive element is cemented to the arcuate inner wall of a housing. A potentiometric position transducer employing linear resistive strips is shown in U.S. Pat. No. 4,693,111 to Arnold et al, wherein three elongate resistive strips are laid out in parallel and used simultaneously for enhanced position signal resolution.

A recognized problem associated with potentiometric position transducers involves wear of the electrically resistive track. Typical film type resistive tracks may be designed to withstand millions of passes or cycles of the sliding electrical contact. Vibration of the sliding contact on the resistive track, however, causes accelerated wear. A 10 Hz vibration, for example, achieves one million cycles in less than 30 hours. In a potentiometric position transducer used to measure throttle position in a motor vehicle engine, for example, the sliding electrical contact will remain in a localized area of the resistive track while the car is driven at a constant speed on flat terrain. Vibration of the electrical sliding contact on the resistive element can cause wear on such localized area. The present invention addresses the problem of localized wear of the resistive track in a potentiometric position transducer.

SUMMARY OF THE INVENTION

According to the present invention, a potentiometric position transducer has a resistive element which provides an electrically resistive track movably mounted within a housing. First and second electrical contacts mounted to the housing make sliding electrical connection with the resistive track at spaced locations. A third electrical contact, moveable in correspondence with a device exterior to the housing, makes sliding contact with the electrically resistive track between the first and second electrical contacts. The moveable electrical contact picks up a position signal from the electrically resistive track which corresponds to its position between the first and second electrical contacts. The position responsive electrical contact passes the position signal to a terminal exterior to the housing. Drive means are provided for moving the resistive track within the housing. Preferably, the drive means moves the resistive track coincident with movement of the position responsive electrical contact. In accordance with this significant feature, the portion of the resistive track positioned between the first and second sliding electrical contacts, which portion serves as the electrically resistive track for the potentiometer, is repeatedly changed by movement of the drive means.

Those skilled in the art of potentiometric position transducers will recognize that repeatedly changing the portion of the resistive track positioned between the first and second sliding contacts will spread the normal wear over the resistive track. This applies both to normal sliding contact wear and to vibration wear caused by vibration of the sliding electrical contact in relatively stationary position on the resistive track. This and additional advantages will be further understood from the following detailed description of certain preferred embodiments.

BRIEF DESCRIPTION OF THE DRAWINGS

In the accompanying drawings like reference characters designate like or corresponding parts throughout the several views of an embodiment of the invention.

Figure 1:
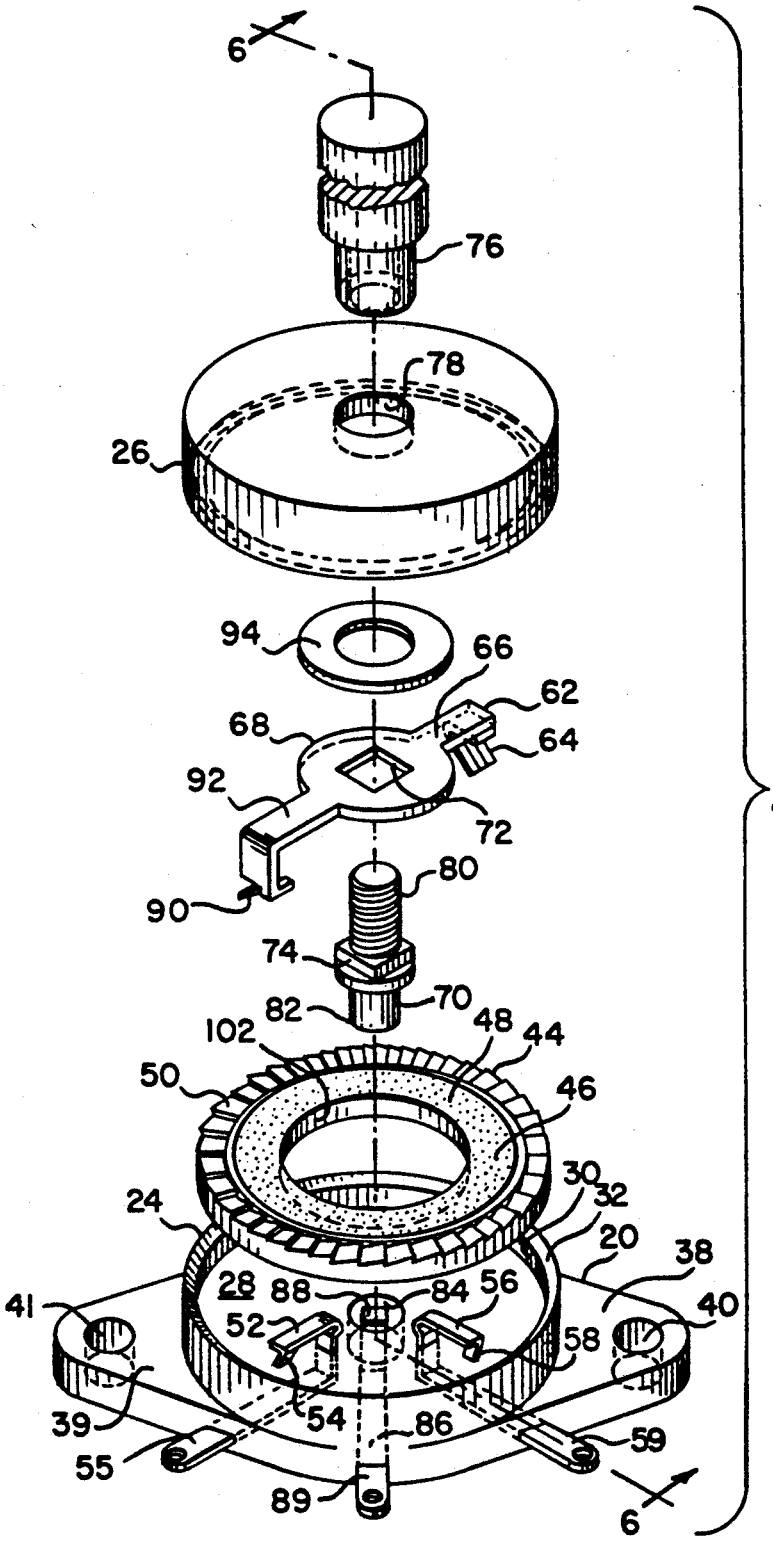
FIG. 1 is an exploded perspective view, partially broken away, of a potentiometric position transducer in accordance with a preferred embodiment of the invention.
Figure 4:
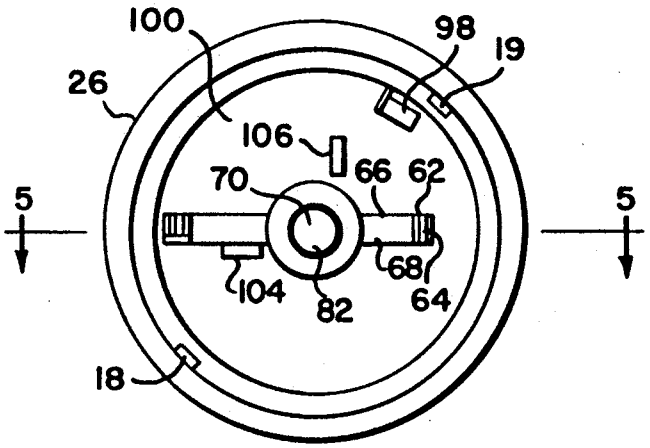
FIG. 4 is a plan view of additional components of the potentiometric position transducer of FIG. 1, shown in sub-assembly.
Figure 5:
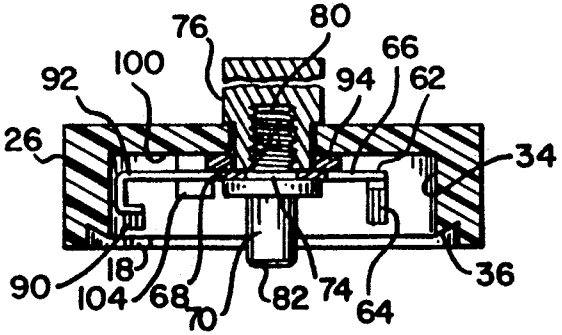
FIG. 5 is a section view of the sub-assembly of FIG. 4, taken along line 5—5 of that figure.
Figure 2:
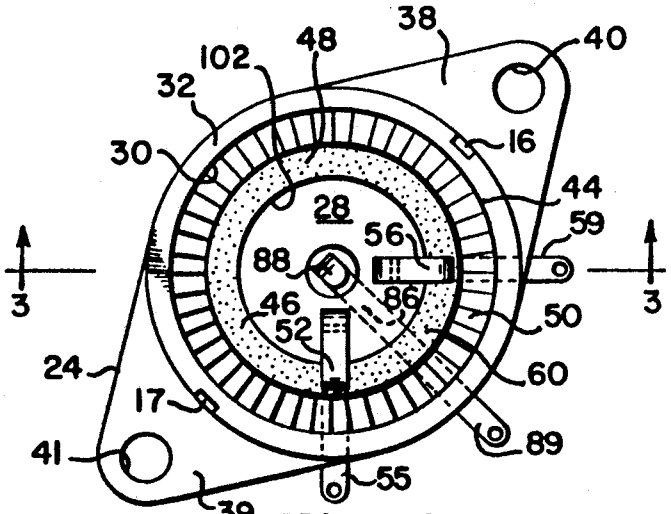
FIG. 2 is a plan view of housing components and resistive element means of the position transducer of FIG. 1, shown in sub-assembly.
Figure 3:
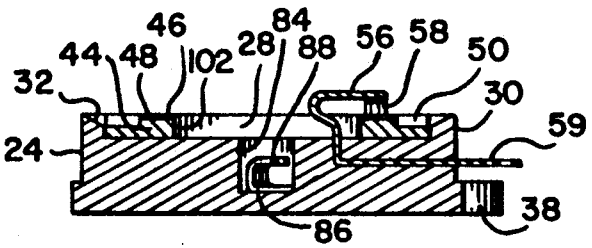
FIG. 3 is a section view of the sub-assembly of FIG. 2, taken along line 3—3 of that figure.
Figure 6:
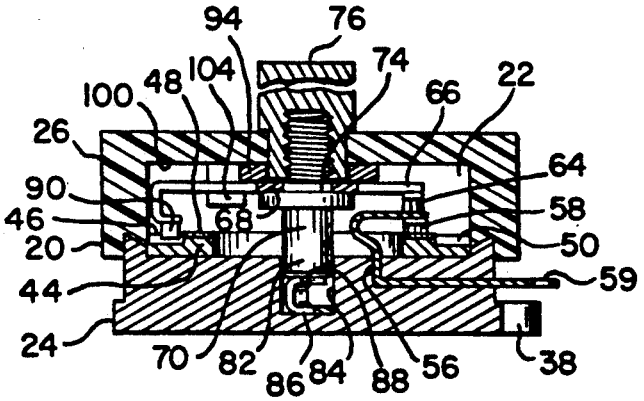
FIG. 6 is a section view of the position transducer of FIG. 1, taken along line 6-6 of that figure, shown in assembly with the torque arm rotated.

Those skilled in the art will recognize that the drawings are not necessarily to scale, with certain films, for example, being shown in exaggerated thickness for clarity of illustration.

DETAILED DESCRIPTION OF THE PREFERRED EMBODIMENTS

In the following detailed description of potentiometric position transducers in accordance with certain preferred embodiments, it should be understood that references to direction and orientation are used for description purposes and generally relate to the orientation and specific features of the embodiment shown in the drawings. Unless otherwise clear from the context of their usage, such references are not intended to in any way limit the orientation or configuration of alternative potentiometric position transducers in accordance with the invention.

Referring now to FIGS. 1-9, a rotary potentiometric position transducer is seen to have a housing 20 defining a housing enclosure 22. The housing comprises a base member 24 and a cover member 26 mounted to the base member 24. Base member 24 defines a cylindrical recess 28 which is a portion of the housing enclosure 22. Recess 28 is formed by upstanding cylindrical wall 30 having a beveled upper surface 32. Downwardly extending cylindrical wall 34 of cover member 26 has corresponding beveled lower surface 36 which seats against beveled surface 32 of the base member 24 in the assembled unit. The mating beveled surfaces aid in positioning the cover member on the base member and provide good resistance to migration of contaminants into the housing enclosure 22. Additionally, keys 18 and 19 (see FIG. 4), unitary downward extensions from the bottom outer rim of cover member 26, mate with keyways 16 and 17 (see FIG. 2), respectively, formed in beveled upper surface 32 of base member 24 to further aid in properly positioning the cover member on the base member. The cover member 26 can be fixed in mounted position on the base member 24 by any suitable fastening or clamping means, of which numerous alternatives are well known to those skilled in the art. The base member and the cover member of the housing both can be formed of molded plastic, employing techniques and materials well known to those skilled in the art. Base member 24 provides flange extensions 38 and 39 having mounting holes 40 and 41, respectively, to receive mounting bolts or the like for mounting the transducer. Alternative mounting means will be readily apparent to those skilled in the art.

A resistive element of the rotary potentiometric position transducer is seen to comprise an annular disk 44 seated in the cylindrical recess 28 in the base member 24. Annular disk 44 preferably is formed of molded plastic, for example injection molded plastic. For ease of assembly, the upper surface 46 of annular disk 44 is substantially flush with the top of cylindrical wall 30 of base member 24. Annular disk 44 is rotatably seated in cylindrical recess 28 and its upper surface 46 is exposed within the housing enclosure 22. It has a circular electrically resistive track 48 on its upper surface 46. It further has a circular ratchet track 50 on upper surface 46, concentric with the circular electrically resistive track 48 and radially outward thereof. As described further below, ratchet track 50 is one element of rotation means for rotating the annular disk in the cylindrical recess.

Figure 8:
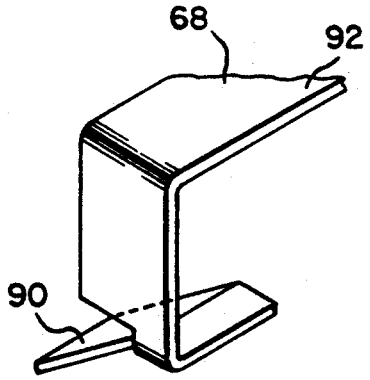
Figure 9:
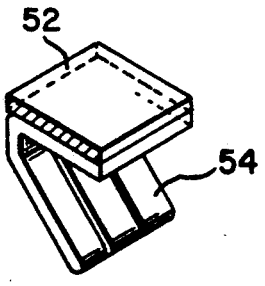
FIG. 9 is an enlarged perspective detail view of the sliding contact feature of the potentiometric position transducer of FIG. 1.

The rotary potentiometric position transducer further comprises first and second electrical contact means for establishing between them an arcuate potentiometer segment of the circular electrically resistive track, as now further described. First electrical contact means 52 has a contact end 54 mounted in fixed position within the housing enclosure 22 and making sliding electrical contact with the circular electrically resistive track 48 at a first location. As viewed in FIG. 2, such first location is seen to be at the bottom center of circular electrically resistive track 48. The first and second electrical contact means each preferably is formed of a flexible metallic strip, for example, a beryllium copper strip, to provide a conductive path and suitable contact force with the electrically resistive track. Such preferred flexibility also allows the contacts to be swung upward toward the center of the device during installation of the annular disk 44. The metallic strip employed for first electrical contact means 52 in the preferred embodiment illustrated in FIGS. 1-9 extends from its contact end 54, through the base member 24 to a terminal end 55 external to the housing. As best seen in FIG. 9, contact end 54 preferably has a multi-finger slider design comprising slanted finger elements to facilitate good sliding contact with the circular electrically resistive track 48 despite normal manufacturing variations in finger length, etc.

The second electrical contact means 56 is substantially the same as the above described first electrical contact means 52. Thus, it extends from a contact end 58 mounted in fixed position within the housing enclosure 22 in sliding electrical contact with the circular electrically resistive track 48 at a second location circumferentially spaced from the first location at which contact end 54 of the first electrical contact means 52 contacts the electrically resistive track 48. As viewed in FIG. 2, the second electrical contact means 56 contacts a center-right location of track 48. Thus, the first and second electrical contact means establish between them a potentiometer segment 60 of the resistive track 48, specifically, a 90° arcuate portion of resistive track 48. Such potentiometer segment 60 is preferably from 60° to 120° of the circular electrically resistive track 48, most preferably being about 90° thereof. In the usual manner, electrical voltage can be applied across the potentiometer segment of the resistive track by attaching one of the terminal ends 55, 59 to a voltage source and connecting the other to ground. Those skilled in the art will recognize that a small shunting current is passed between the first and second electrical contact means via the long way around the circular resistive track. Such shunting current does not substantially adversely affect the performance of the potentiometric position transducer.

The transducer further comprises position responsive electrical contact means 62 mounted to the housing for picking up a position signal from the potentiometer segment 60 of the circular electrically resistive track 48. The position responsive electrical contact means 62 comprises a moveable contact end 64 in sliding electrical contact with the potentiometer segment 60. Contact end 64 preferably has substantially the same multi-finger slider design illustrated in FIG. 9 for contact end 54. The contact ends 54 and 58 can each make sliding electrical contact with the circular electrically resistive track 48 on a common first arcuate path. The moveable contact end 64 can make sliding electrical contact with the electrically resistive track 48 along the same arcuate path, but preferably makes contact on a second path concentric with, and radially spaced from, the first path. The second path may be either radially inward or outward of the first path. This preferred embodiment further distributes wear on the resistive track.

In addition to the moveable contact end 64, the position responsive electrical contact means comprises linkage means for rotating the moveable contact end to a location on the potentiometer segment 60 corresponding to a position of an exterior device, and terminal means for carrying the position signal. The linkage means of the embodiment illustrated in FIGS. 1-9 comprises a first radial arm 66 of an electrically conductive torque member 68 mounted in electrical connection with an electrically conductive center pin 70. Conductive torque member 68 is mounted in rotationally fixed relation to the center pin 70 by means of square aperture 72 of torque member 68 seated around square nut portion 74 of pin 70. Radial arm 66 of torque member 68 extends radially from center pin 70 to moveable contact end 64. The linkage means further comprises an electrically insulated member 76 mounted vertically through center aperture 78 in cover member 26. Upper end 80 of electrically conductive center pin 70 is attached in rotationally fixed relation to the electrically insulated member 76. The lower end 82 of pin 70 is freely rotatably received in pin well 84 which is formed in base member 24 concentric with shallow recess 28. Thus, rotation of electrically insulated member 76 corresponding to movement of a device exterior to the potentiometric position transducer will cause corresponding rotation of center pin 70 and, in turn, rotation of electrically conductive torque member 68, thereby moving contact end 64 back and forth in an arc over potentiometer segment 60 to pick up a position signal corresponding to the position of the exterior device.

The aforesaid terminal means is formed preferably of a metallic strip 86 made of a flexible metal, such as beryllium copper, to provide a conductive path and suitable contact force. Metal strip 86 extends from a fixed contact end 88 within pin well 84, where it forms electrical contact with lower end 82 of pin 70, through base member 24 of the housing to a terminal end 89 exterior to the housing. Thus, a potentiometer signal corresponding to the position of an exterior device linked to moveable contact end 64 is passed through the electrically conductive torque member 68 to pin 70, to contact 88 of metal strip 86, to exterior terminal 89, whence it can be passed to suitable signal processing circuitry.

The rotary potentiometric position transducer further comprises drive means for moving the electrically resistive track within the housing to repeatedly change the potentiometer portion of the electrically resistive track between the contact ends of the first and second electrical contact means. More specifically, the rotary potentiometric position transducer of FIGS. 1-9 comprises rotation means for rotating the annular disk 44 in the cylindrical recess 28 to change the potentiometer segment 60 of the circular electrical resistive track 48 between the contact ends 54 and 58 of the first and second electrical contact means, respectively. The rotation means comprises a drive pawl 90 engaging circular ratchet track 50 of the annular disk 44. The drive pawl 90 is rotatable by the above described linkage means coincident with rotation of the moveable contact end 64 of the position responsive electrical contact means. More specifically, drive pawl 90 is at the end of a second radial arm 92 of the torque member 68. Second radial arm 92 extends from the center pin 70 in a direction radially opposite first radial arm 66 of torque member 68.

Figure 7:
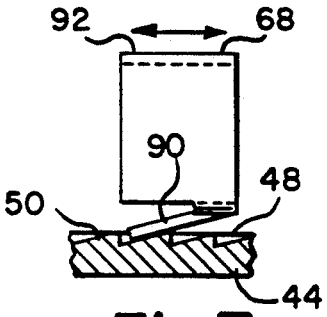
FIGS. 7 and 8 are enlarged detail views, FIG. 7 being partly in cross-section, of the rotational drive pawl and ratchet feature of the potentiometric position transducer of FIG. 1.

The drive pawl 90 can be a separately formed unit welded or otherwise attached to the radial arm, similar to the embodiment illustrated in FIG. 9 for the contact ends. Alternatively, as illustrated in FIGS. 7 and 8, the drive pawl can be formed by suitably bending and cutting the outer end of radial arm 92. Drive pawl 90 is seen engaging the circular ratchet track 50 in FIG. 7. The double ended arrow in FIG. 7 indicates that the radial arm is free to rotate in both directions under the influence of the linkage means. Rotation of radial arm 92 to the left (i.e., clockwise rotation of torque member 68 viewed from above as in FIG. 1) will cause drive pawl 90 to push the ratchet track 50, and hence annular disk 44, also to the left (i.e., also clockwise as viewed from above in FIG. 1). Rotation of radial arm 92 to the right (i.e., counterclockwise rotation of torque member 68 viewed from above as in FIG. 1) will cause drive pawl 90 to slide to the right over the ratchet track 50. Thus, back and forth rotation of torque member 68 under the influence of the linkage means causes repeated incremental rotation of annular disk 44, causing corresponding repeated changes of the portion of the circular electrically resistive track 48 serving as the potentiometer segment 60. Thus, wear of the potentiometer segment 60 is distributed over the entire circular track, thereby extending its useful life. Generally, in preferred embodiments of the rotary potentiometric position transducer, an increased number of ramped teeth in ratchet track 50 around the circumference of annular disk 44 results in correspondingly improved uniformity of wear of electrically resistive track 48. A spring washer 94 is employed preferably between the torque arm 68 and the cover member of the housing to maintain good contact pressure between the moveable contact end 64 and the potentiometer segment 60, and also between the drive pawl 90 and the ratchet track 50.

Preferably, the rotary potentiometric position transducer further comprises anti-reverse rotation means for limiting rotation of the annular disk by the rotation means to a single direction. In the preferred embodiment illustrated in FIGS. 1-9, the anti-rotation means comprises an anti-reverse pawl 98 engaging the annular disk 44. The anti-reverse pawl 98 preferably is mounted to the inside surface 100 of the cover member 26 of the housing. For example, the anti-reverse pawl can be attached to a rectangular block of plastic molded into the cover member. Thus, counterclockwise rotation (viewed from above as in FIG. 1) is prevented by the anti-reverse pawl, causing the drive pawl 90 to ride over the ramps of ratchet track 50. The anti-reverse pawl engages ratchet track 50.

Preferably, rotation limiting means are provided for limiting the rotation of the torque member such that the moveable contact end 64 remains within the potentiometer segment 60 of the electrically resistive track 48. For this purpose, mechanical stops can be provided as rectangular (or other shape) blocks of plastic molded into the inside surface 100 of cover member 26. Such mechanical stops included in preferred embodiments of the potentiometric position transducer prevent excessive rotation of torque member 68.

Figure 10:
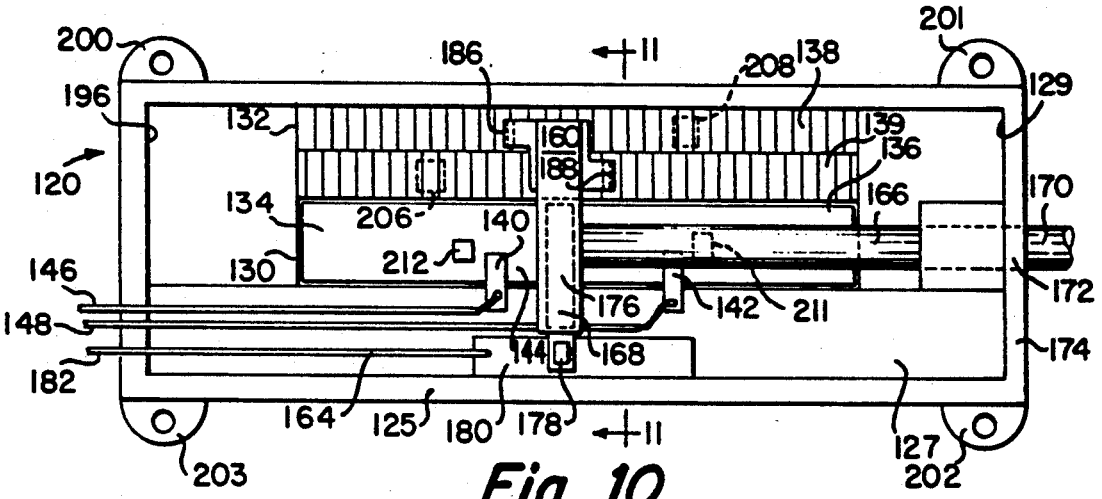
FIG. 10 is an plan view of a linear potentiometric position transducer in accordance with a second embodiment of the invention.
Figure 11:
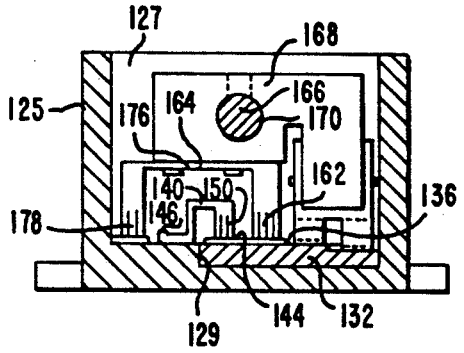
FIG. 11 is a section view of the potentiometric position transducer of FIG. 10, taken along line 11—11 of that figure.
Figure 12:
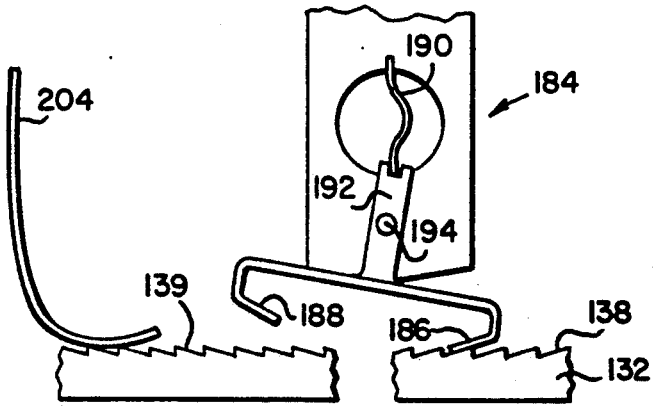
FIG. 12 is an enlarged detail view, partly in section and partly broken away, of the reversible pawl and ratchet features of the potentiometric position transducer of FIGS. 10 and 11.

Those skilled in the art will recognize that the motion of a linearly moving external device can be coupled via a flexible rod through a circumferential guide to drive a rotary potentiometer embodiment, such as that described above in connection with FIGS. 1–9. Alternatively, a linear potentiometer embodiment of the invention may be provided wherein a resistive element is laid down on an endless belt or on the surface of a drum, a changing portion of the resistive element being employed as a potentiometer segment. The belt or drum could be moved over rollers or other suitable mounting means, preferably by the same linkage means used for linking the potentiometric signal pick-up to the exterior device, such that the portion of the resistive track employed as the potentiometer segment would change repeatedly. This would distribute the wear of the resistive track over its entire length. A particularly preferred embodiment of a linear potentiometric position transducer is illustrated in FIGS. 10–12. In such preferred embodiment of the invention, now discussed in detail, a flat resistive element on a surface of shuttle block is shuttled back and forth within a housing, only a portion of the track being used as a potentiometer segment or portion. The shuttling motion of the shuttle block repeatedly changes the portion of the track used as the potentiometer segment.

More specifically, FIGS. 10–12 illustrate a linear potentiometric position transducer 120 comprising a housing 125 forming a housing enclosure 127 which includes a recess 129. Resistive element 130 comprises a shuttle block 132 slidably seated in recess 129. Linear strip electrical resistance track 134 on upper surface 136 of shuttle block 132 is exposed within the enclosure 127. Oppositely faced first and second linear ratchet tracks 138, 139 extend parallel the electrical resistance track 134 on the upper surface 136 of the shuttle block 132. Preferably, shuttle block 132 is formed of molded plastic, the linear ratchet tracks 138, 139 being molded into the upper surface 136 of the block 132.

First and second fixed electrical contact means 140, 142 are provided for establishing between them a linear potentiometer portion 144 of the electrical resistance track 134. First electrical contact means 140 is connected to a lead 146 to a terminal end exterior to the housing. Similarly, second electrical contact means 142 is connected by electrical lead 148 to a terminal end exterior to the housing. These leads are connected to a voltage source and ground in the usual way to provide a voltage gradient across potentiometer portion 144. In particular, first electrical contact means 140 has a contact end 150 in fixed position within the housing 125, making sliding electrical contact with the electrical resistance track 134. Similarly, second electrical contact means 142 has a contact end mounted in fixed position within the housing 125, making sliding electrical contact with the electrical resistance track 134. The potentiometer portion 144 is established between the two contact ends.

The linear potentiometric position transducer further comprises position responsive electrical contact means 160 mounted to the housing 125 for picking up a position signal from the linear potentiometer portion 144. The position responsive electrical contact means 160 comprises a moveable contact end 162 in sliding electrical contact with the linear potentiometer portion 144. Terminal means for electrically conducting the position signal out of the housing to an exterior terminal comprises a lead 164. Linkage means 166 for moving the moveable contact end 162 to a location on the linear potentiometer portion 144 corresponding to the position of an exterior device comprises a carrier block 168 mounted within the housing 125 on a push rod 170 passing through a guide hole 172 in a wall 174 of the housing 125. The push rod provides linear movement of the carrier block 168 over the linear potentiometer portion 144. The carrier block 168 carries an electrically conductive bridging means 176 which forms the moveable contact end 162 at a first end and a terminal contact 178 at a second end. The terminal contact 178 is in sliding electrical contact with a high conductivity strip 180 extending parallel the linear potentiometer portion 144. High conductivity strip 180 is electrically connected to lead 182 extending to a terminal exterior to the housing 125 and, in use, to suitable signal processing circuitry.

Suitable shuttle means are provided for moving the shuttle block 132 back and forth in the recess 129 coincident with movement of the moveable contact end 162. Such shuttle means in the preferred embodiment of FIGS. 10–12 comprises a dual tang snap action pawl 184 having alternating first and second conditions. In the first condition a first tang 186 of the snap action pawl 184 engages the first ratchet track 138. Tang 186 engages track 138 when snap action pawl 184 is in the condition shown in FIG. 12. In such first condition, the second tang 188 of the dual tang snap action pawl 184 is disengaged. In the second condition, the second tang 188 engages the second ratchet track 139 and the first tang 186 is disengaged. Automatic shuttling of the shuttle block 132 back and forth (that is, from right to left and from left to right as viewed in FIG. 10) is accomplished by transmitting corresponding motions of shaft 170 to the shuttle block via one or the other tang 186, 188. Spring 190 mounted between pivotably mounted tang arm 192 and carrier block 168 provides the snap action force to alternately engage and disengage the two tangs 186, 188 by causing pivoting motion of arm 192 on pin 194. Thus, when push rod 170 moves carrier block 168 to the left, tang 186 pushes block 132 correspondingly to the left when it is engaged with track 138. When shuttle block 132 is pushed into contact with inside surface 196 of housing 125, further leftward movement of carrier block 168 causes arm 192 to reverse position, disengaging tang 186 from ratchet track 138 and engaging tang 188 with oppositely faced ratchet track 139. In that second condition, only rightward movement of carrier block 168 moves block 132 until block 132 reaches inside surface 129 of housing 125. At that point the dual tang snap action pawl 184 snaps back to its first condition and the process repeats itself.

Downward projections from a cover member of housing 125 (not shown) can be provided to act as mechanical stops to limit motion of carrier block 168, such that moveable contact end 162 is kept within the potentiometer portion 144 of the electrical resistance track 134. Push rod 170 can be fastened to carrier block 168 by set screw or other suitable means. Housing 125 is mountable to a mounting surface by tabs 200–203. Alternative suitable mounting means will be readily apparent to those skilled in the art. Preferably, biasing means are provided for resiliently holding the shuttle block 132 in recess 129. In the preferred embodiment of FIGS. 10–12, resilient metal strips 204 provide downward pressure on upper surface 136 of block 132 at locations 206 and 208, providing a sliding engagement with surface 136. Mechanical stops 211 and 212 are provided to limit travel of the carrier block 168.

While certain preferred embodiments are discussed in detail above, those skilled in the art will recognize that various alternative and modified embodiments are possible within the true scope and spirit of the invention. The following claims are intended to cover all such modifications and alternative embodiments.

I claim:

1. A potentiometric position transducer comprising:

a housing;

resistive element means for providing an electrically resistive track movably mounted within the housing;

first and second electrical contact means mounted to the housing for defining first and second end points, respectively, of a potentiometer portion of the electrically resistive track, each having a contact end within the housing in sliding electrical contact with the electrically resistive track at spaced first and second locations, respectively, and each having a terminal end exterior to the housing;

position responsive electrical contact means mounted to the housing for picking up a position signal from the potentiometer portion of the electrically resistive track, having a movably mounted contact end within the housing in sliding electrical contact with the potentiometer portion of the electrically resistive track, and a terminal exterior to the housing, the position signal corresponding to the position of the movably mounted contact end on the potentiometer portion of the electrically resistive track; and drive means for moving the electrically resistive track within the housing to change the potentiometer portion of the electrically resistive track between the contact ends of the first and second electrical contact means.

2. The potentiometric position transducer of claim 1 wherein the drive means is a one way clutch for moving the electrically resistive track coincident with movement of the movably mounted contact end of the position responsive electrical contact means.

3. The potentiometric position transducer of claim 1 wherein the resistive element means comprises the electrically resistive track in fixed position on a first surface area of a carrier movably mounted within the housing, and the drive means comprises a drive pawl engaging a ratchet surface area of the carrier, the drive pawl being mounted for movement coincident with movement of the movably mounted contact end of the position responsive electrical contact means, to move the carrier within the housing and to correspondingly move the electrically resistive track.

4. The potentiometric position transducer of claim further comprising anti-reverse means for limiting movement of the electrically resistive track by the drive means to a single direction within the housing.

5. The potentiometric position transducer of claim 4 wherein the anti-reverse means comprises a second pawl engaging said ratchet surface area of the carrier.

6. The potentiometric position transducer of claim 1 wherein the first and second electrical contact means each is mounted in fixed position to the housing, extending from its contact end within the housing, through the housing, to its terminal end exterior to the housing.

7. The potentiometric position transducer of claim 1 wherein the resistive element means comprises a shuttle block linearly slidably seated in a recess within said housing, and said drive means comprises a dual tang snap action pawl.

8. A rotary potentiometric position transducer comprising:

a housing defining a housing enclosure, comprising a base member forming a cylindrical recess as a portion of the housing enclosure and a cover member mounted to the base member;

a resistive element comprising an annular disk rotatably seated in the cylindrical recess and having an upper surface exposed within the housing enclosure, a circular electrically resistive track on the upper surface of the annular disk, and a circular ratchet track on the upper surface of the annular disk concentric with the circular electrically resistive track;

first and second electrical contact means, each having a contact end mounted in fixed position within the housing enclosure and making sliding electrical contact with the circular electrically resistive track at spaced first and second locations, respectively, for establishing between them an arcuate potentiometer segment of the circular electrically resistive track, and each having a terminal end exterior to the housing;

position responsive electrical contact means mounted to the housing for picking up a position signal from the potentiometer segment of the circular electrically resistive track comprising (a) a moveable contact end in sliding electrical contact with the potentiometer segment, (b) terminal means for carrying the position signal, comprising a fixed contact end within the housing enclosure electrically connected to the moveable contact end, and a terminal end exterior to the housing electrically connected to the fixed contact end, and (c) linkage means for rotating the moveable contact end to a location on the potentiometer segment corresponding to a position of an exterior device; and rotation means for rotating the annular disk in the cylindrical recess, to change the potentiometer segment of the circular electrical resistance track between the contact ends of the first and second electrical contact means, the rotation means comprising a drive pawl engaging the circular ratchet track of the annular disk, the drive pawl being rotatable by the linkage means coincident with rotation of the moveable contact end of the position responsive electrical contact means.

9. The rotary potentiometric position transducer of claim 8 wherein the circular ratchet track is radially outward of the circular electrical resistance track on the upper surface of the annular disk.

10. The rotary potentiometric position transducer of claim 8 further comprising anti-reverse rotation means for limiting rotation of the annular disk by the rotation means to a single direction.

11. The rotary potentiometric position transducer of claim 10 wherein the anti-reverse rotation means comprises an anti-reverse pawl engaging the annular disk.

12. The rotary potentiometric position transducer of claim 11 wherein the anti-reverse pawl engages an inside cylindrical surface of the annular disk.

13. The rotary potentiometric position transducer of claim 8 wherein the potentiometer segment is from 60° to 120° of the circular electrically resistive track.

14. The rotary potentiometric position transducer of claim 8 wherein the first and second electrical contact means each comprises a metallic strip passing through the housing, extending from its contact end at which it forms a resiliently curled free end contacting the circular electrically resistive track, to its terminal end exterior to the housing.

15. The rotary potentiometric position transducer of claim 8 wherein (a) the terminal means is formed of a metallic strip extending from its fixed contact end exposed in a pin well in the base portion of the housing at the center of the cylindrical recess, through the base member to its terminal end exterior to the housing, (b) the linkage means comprises (i) an electrically insulated member rotatably mounted through the cover member of the housing, (ii) an electrically conductive center pin rotatably mounted in the housing, having one end received freely in the pin well in electrical contact with the fixed contact end and an opposite end attached in rotationally fixed relation to the electrically insulated member, and (iii) a first radial arm of an electrically conductive torque member mounted in electrical connection with and rotationally fixed relation to the center pin, said first radial arm extending from the center pin and terminating as the moveable contact end in sliding electrical contact with the potentiometer segment of the circular electrical resistance track, and (c) the rotation means further comprises a second radial arm of said torque member extending from the center pin and terminating as the drive pawl of the rotation means engaging the circular ratchet track of the annular disk.

16. The rotary potentiometric position transducer of claim 8 wherein the contact end of the first and second electrical contact means each makes sliding electrical contact with the circular electrically resistive track along a common first circular path, and the moveable contact end of the position responsive electrical contact means makes sliding electrical contact with the circular electrically resistive track along a second circular path concentric with and radially spaced from the first circular path.

17. A linear potentiometric position transducer comprising:

a housing forming a housing enclosure and defining a recess within the housing enclosure;

a resistive element comprising (a) a shuttle block slidably seated in the recess, (b) a linear strip electrical resistance track on an upper surface of the shuttle block exposed within the enclosure, and (c) oppositely faced first and second linear ratchet tracks extending parallel the electrical resistance track on the upper surface of the shuttle block;

first and second electrical contact means, each having a contact end mounted within the housing in fixed position and making sliding electrical contact with the electrical resistance track, establishing between them a linear potentiometer portion of the electrical resistance track, and a terminal end exterior to the housing;

position responsive electrical contact means mounted to the housing for picking up a position signal from the linear potentiometer portion of the electrical resistance track, comprising (a) a moveable contact end in sliding electrical contact with the linear potentiometer portion, (b) terminal means for conducting the position signal out of the housing, and (c) linkage means for moving the moveable contact end to a location on the linear potentiometer portion corresponding to a position of an exterior device; and shuttle means for moving the shuttle block back and forth in the recess coincident with movement of the moveable contact end, comprising a dual tang snap action pawl having alternating first and second conditions, wherein in the first condition a first tang of the snap action pawl engages the first ratchet track of the resistive element, and in the second condition a second tang of the snap action pawl engages the second ratchet track.

18. The linear potentiometric position transducer of claim 17 wherein the linkage means comprises a carrier block mounted within the housing on a push rod passing through a guide hole in a wall of the housing for linear movement of the carrier block over the linear potentiometer portion, the carrier block carrying an electrically conductive bridging means for forming said moveable contact end at a first end and a terminal contact at a second end, the terminal contact being in sliding electrical contact with said terminal means comprising a high conductivity strip extending parallel the linear potentiometer portion.

19. The linear potentiometric position transducer of claim 17 further comprising biasing means for resiliently holding the shuttle block in the recess.

* * * * *